US009958818B2

(12) United States Patent
Kuriki et al.

(10) Patent No.: US 9,958,818 B2
(45) Date of Patent: May 1, 2018

(54) FIXING DEVICE COMPRISING ENDLESS BELT AND ROTARY BODY

(71) Applicant: BROTHER KOGYO KABUSHIKI KAISHA, Nagoya-shi, Aichi-ken (JP)

(72) Inventors: Hirofumi Kuriki, Nagoya (JP); Yasumasa Fujii, Anjo (JP); Akihiro Kobayashi, Yokkaichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/606,101

(22) Filed: May 26, 2017

(65) Prior Publication Data

US 2017/0343935 A1 Nov. 30, 2017

(30) Foreign Application Priority Data

May 30, 2016 (JP) ..... 2016-107223
May 22, 2017 (JP) ..... 2017-100713

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/20; G03G 15/2064; G03G 15/2089
See application file for complete search history.

(56) References Cited

U.S. PATENT DOCUMENTS 8,280,291 B2 * 10/2012 Yamamoto ..... G03G 15/657 399/329
8,346,147 B2 * 1/2013 Yagi ..... G03G 15/2053 399/329
8,385,802 B2 * 2/2013 Okabe ..... G03G 15/2064 399/329
2004/0131401 A1 * 7/2004 Nakatogawa ..... G03G 15/2053 399/328
2006/0029444 A1 * 2/2006 Naito ..... G03G 15/2064 399/329
2006/0257180 A1 * 11/2006 Nakagawa ..... G03G 15/206 399/329
2008/0003006 A1 * 1/2008 Tsukamura ..... G03G 15/2032 399/67

(Continued)

FOREIGN PATENT DOCUMENTS

JP 2007-248858 A 9/2007
JP 2010-231008 A 10/2010

(Continued)

*Primary Examiner* — Francis Gray
(74) *Attorney, Agent, or Firm* — Merchant & Gould P.C.

(57) ABSTRACT

A fixing device including an endless belt, a rotary body positioned outside of the endless belt, the rotary body having an axis extending in an axial direction, an elastic member positioned at an inner space of the endless belt and configured to nip the endless belt in cooperation with the rotary body, and an adhering member having rigidity higher than rigidity of the elastic member. The elastic member has a contact surface in contact with the endless belt. The adhering member has an adhered portion adhered to an opposite surface opposite to the contact surface. The adhering portion has a length in the axial direction smaller than the length of the elastic member in the axial direction.

16 Claims, 10 Drawing Sheets

(56) References Cited

U.S. PATENT DOCUMENTS

| | | | | |
|---|---|---|---|---|
| 2010/0196066 | A1* | 8/2010 | Tamemasa ..... | G03G 15/2025 399/329 |
| 2010/0247186 | A1 | 9/2010 | Tanaka et al. | |
| 2011/0052237 | A1* | 3/2011 | Yoshikawa ..... | G03G 15/2053 399/69 |

FOREIGN PATENT DOCUMENTS

| | | | |
|---|---|---|---|
| JP | 2011008062 | A | 1/2011 |
| JP | 5974909 | B2 * | 8/2016 |

* cited by examiner

FIXING DEVICE COMPRISING ENDLESS BELT AND ROTARY BODY

CROSS REFERENCE TO RELATED APPLICATION

This application claims priorities from Japanese Patent Application No. 2016-107223 filed May 30, 2016 and Japanese Patent Application No. 2017-100713 filed May 22, 2017. The entire content of each of the priority applications is incorporated herein by reference.

TECHNICAL FIELD

The present disclosure relates to a fixing device for fixing developing agent to an image recording medium.

BACKGROUND

Japanese Patent Application Publication No. 2010-231008 discloses a fixing device for fixing developing agent to an image recording medium. The fixing device includes a rotary heat member, an endless belt in contact with an outer peripheral surface of the rotary heat member and circularly movable, and a pressure member facing an inner peripheral surface of the endless belt to press the endless belt toward the rotary heat member. The pressure member includes a pad member made from an elastic material such as rubber. The pad member is adhered with an adhesive agent to a fixing surface of a head member made from high hardness material such as synthetic resin and metal.

SUMMARY

A nip region is provided between the endless belt and the rotary heat member, and the nip region has a nip width which is a length of the nip region in a conveying direction of the image recording medium. Here, in order to restrain generation of wrinkle in the image recording medium, the nip length at each end portion of the nip region in an axial direction of the rotary heat member should be greater than the nip width at a center or intermediate portion of the nip region in the axial direction. Conventionally, the desired nip width is set by a desired configuration of the pad member. However, formation of the pad member into a desired configuration involves difficulty, and therefore, the nip width is not easily set.

It is therefore an object of the disclosure to provide a fixing device facilitating setting of the nip width.

This, and other object will be attained by providing a fixing device having: an endless belt defining an inner space; a rotary body positioned outside of the endless belt, the rotary body having an axis extending in an axial direction; an elastic member positioned at the inner space and configured to nip the endless belt in cooperation with the rotary body, the elastic member having a contact surface in contact with the endless belt, and an opposite surface opposite to the contact surface, the elastic member having a length in the axial direction; and an adhering member having rigidity higher than rigidity of the elastic member, and having an adhering portion adhered to the opposite surface of the elastic member, the adhering portion having a length in the axial direction smaller than the length of the elastic member with respect to at least one cross-sectional plane of the adhering member perpendicular to a conveying direction of an image recording medium.

BRIEF DESCRIPTION OF THE DRAWINGS

The particular features and advantages of the disclosure will become apparent from the following description taken in connection with the accompanying drawings, in which.

DETAILED DESCRIPTION

A fixing device according to one embodiment will be described with reference to FIGS. 1 through 6B. Throughout the description, the terms "upward", "downward", "upper", "lower", "above", "below", "beneath", "right", "left", "front", "rear" and the like will be used on a basis of an orientation in FIG. 1 in which right side and left side in FIG. 1 will be referred to as front side, and rear side, respectively, and near side and far side in FIG. 1 will be referred to as left side and right side, respectively. Further, upper side and lower side in FIG. 1 will be referred to as upper side and lower side.

Figure 1:
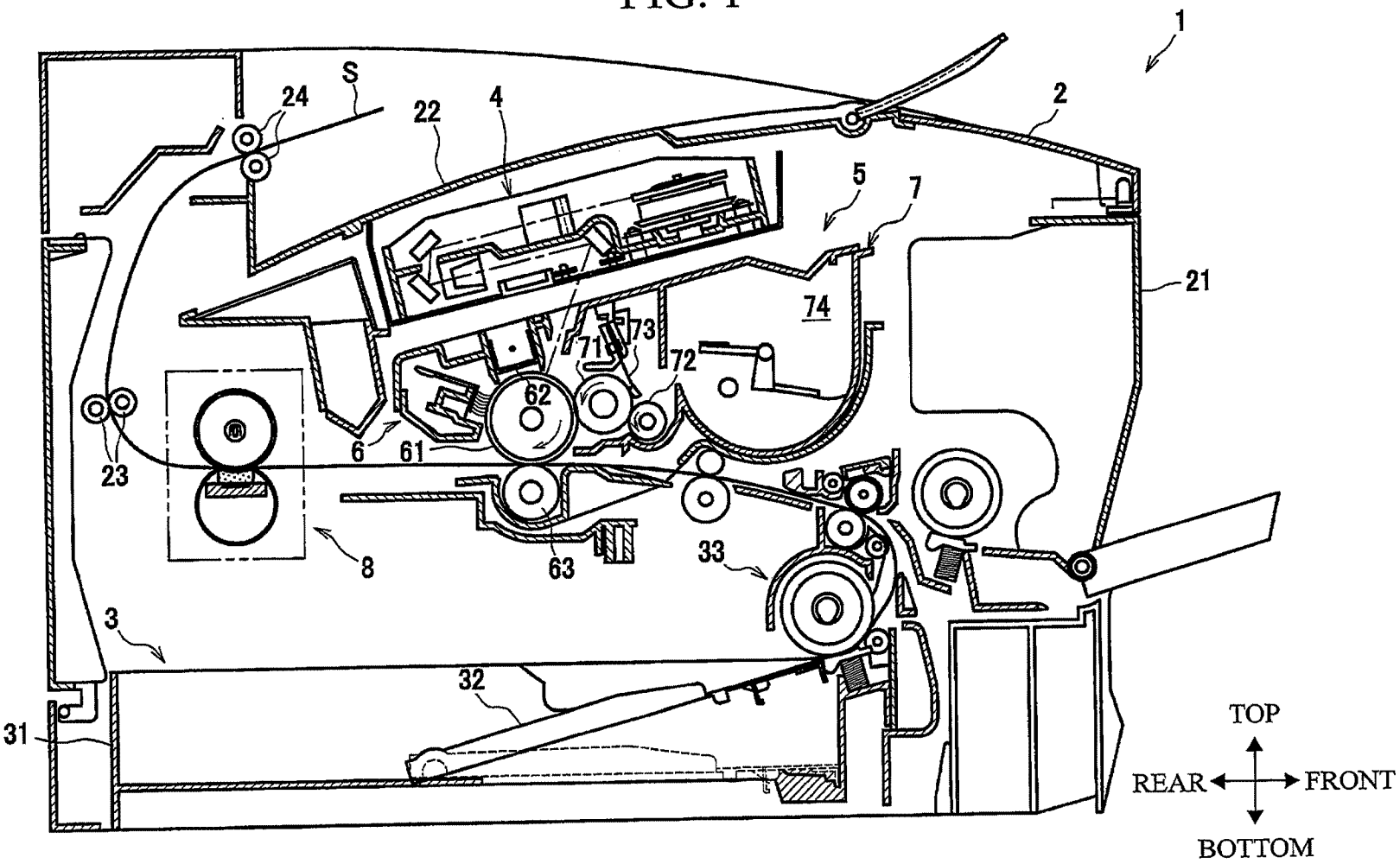
FIG. 1 is a cross-sectional view of an image forming apparatus provided with a fixing device according to one embodiment.

A laser printer 1 is illustrated in FIG. 1 as an image farming apparatus. The laser printer 1 includes a housing 2, a sheet supply device 3, an exposure device 4, a process cartridge 5, and a fixing device 8 those being accommodated in the housing 2. The housing 2 has an opening at its front side, and a cover 21 is provided to open and close the opening. Further, a discharge tray 22 is provided at a top surface of the housing 2 for receiving a sheet S.

The sheet supply device 3 is disposed in a lower portion of the housing 2. The sheet supply device 3 includes a sheet-supply tray 31, a lifter plate 32, and a sheet-supplying mechanism 33. The sheet-supply tray 31 is configured to accommodate sheets S as image recording mediums. The lifter plate 32 is configured to lift front end portion of the sheets S toward the sheet-supplying mechanism 33. The sheet-supplying mechanism 33 is configured to supply the sheets S to the process cartridge 5.

The exposure device 4 is disposed in an upper portion of the housing 2. The exposure device 4 includes a light source device (not illustrated), a polygon mirror, lenses, reflection mirrors, and the like (illustrated without reference numerals). In the exposure device 4, the light source device is configured to irradiate a laser beam (depicted by a dotted chain line in FIG. 1) on a basis of image data, and the beam is scanned over a surface of a photosensitive drum 61 (described later) at a high speed to expose the surface of the photosensitive drum 61 to light.

The process cartridge 5 is disposed below the exposure device 4. The process cartridge 5 is detachably mountable in the housing 2 through the opening of the housing 2, when the cover 21 is opened. The process cartridge 5 includes a drum unit 6, and a developing unit 7. The drum unit 6 includes the photosensitive drum 61, a charger 62, and a transfer roller 63. The developing unit 7 is detachably mountable on the drum unit 6. The developing unit 7 includes a developing roller 71, a supply roller 72, a thickness-regulation blade 73, and a toner-accommodating section 74 for accommodating toner as an example of a developing agent.

In the process cartridge 5, the charger 62 is configured to uniformly charge the surface of the photosensitive drum 61, and then the surface is exposed to the laser beam irradiated from the exposure device 4, forming an electrostatic latent image on the photosensitive drum 61 on a basis of the image data. Further, the supply roller 72 is configured to supply toner in the toner-accommodating section 74 onto the developing roller 71. The toner carried on the developing roller 71 is then regulated into a thin layer having a uniform thickness by the thickness-regulation blade 73. The developing roller 71 is configured to supply the toner to the electrostatic latent image formed on the photosensitive drum 61, thereby developing the latent image into a visible toner image. Subsequently, the toner image formed on the photosensitive drum 61 is transferred onto a sheet S as the sheet S is conveyed between the photosensitive drum 61 and transfer roller 63.

The fixing device 8 is disposed rearward of the process cartridge 5. The fixing device 8 is adapted to fix the toner image onto the sheet S when the sheet S passes through the fixing device 8. The conveyer rollers 23, 24 are positioned downstream of the fixing device 8 in the sheet conveying direction. The sheet S on which the toner image is fixed is discharged onto the discharge tray 22 by the conveyer rollers 23, 24.

Figure 2A:
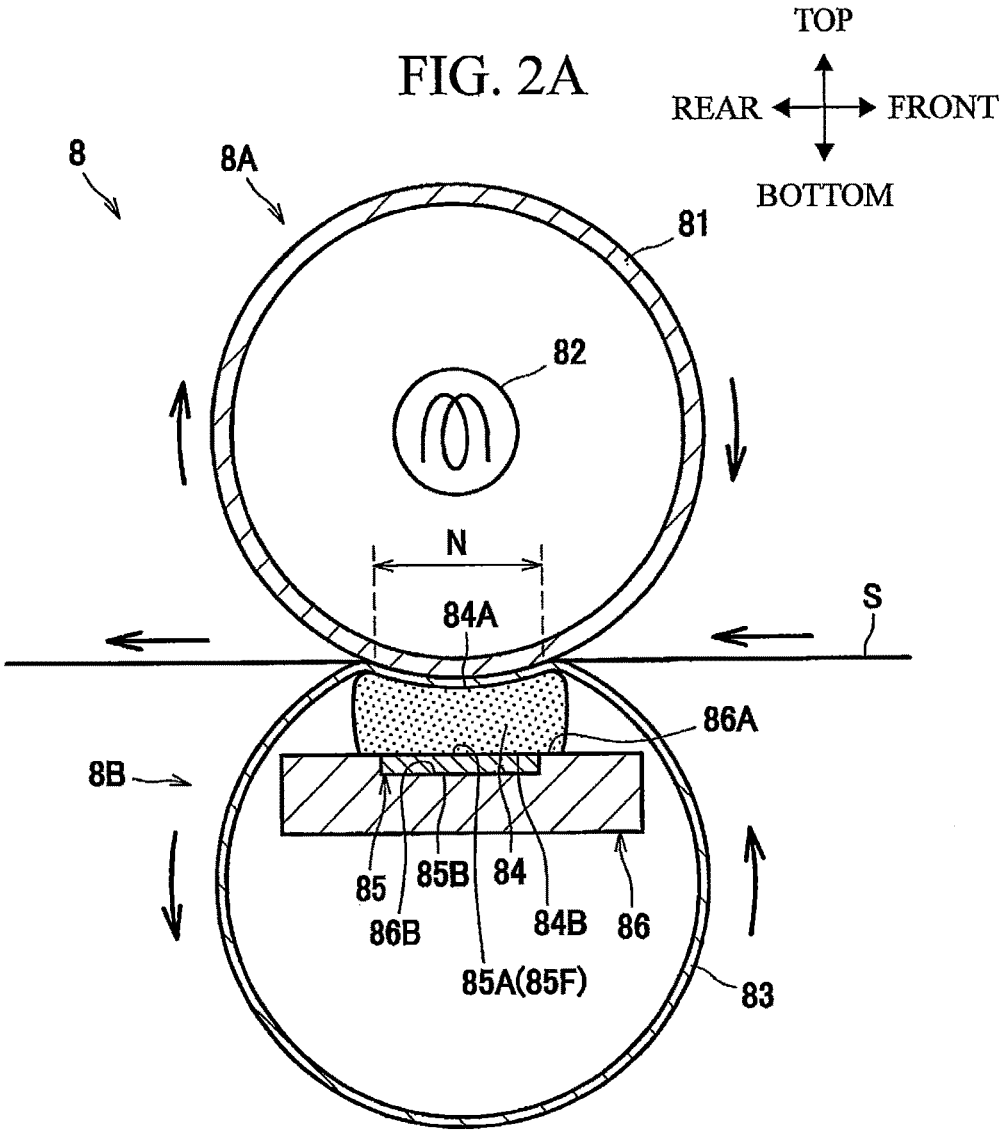
FIG. 2A is a cross-sectional view of the fixing device according to the embodiment as viewed in an axial direction of the fixing device.

As illustrated in FIG. 2A, the fixing device 8 primarily includes a heat unit 8A and a pressure unit 8B in order to fix the toner image onto the sheet S. The heat unit 8A includes a heat roller 81 as an example of a rotary body, and a halogen lamp 82. The pressure unit 8B includes an endless belt 83, an elastic member 84, an adhering plate 85 as an example of an adhering member, and a holding member 86.

In the following description, an axial direction of the heat roller 81 will be referred to as "an axial direction", and a conveying direction of the sheet S at the fixing device 8 will be referred to as "a conveying direction". The axial direction is coincident with a longitudinal direction of the endless belt 83, and corresponds to "a leftward/rightward direction" in the depicted embodiment. Further, the conveying direction is an extending direction of a straight line (a straight line of the sheet S in FIG. 2A), provided by connecting together each end of a nip region N provided between the heat roller 81 and the endless belt 83 as viewed in the axial direction. In the depicted embodiment, the conveying direction corresponds to "a frontward/rearward direction".

As illustrated in FIGS. 2A, 3, 5A, and 5B, the heat roller 81 is a hollow cylindrical member elongated in the axial direction. For example, the heat roller 81 includes a primary tubular member 81A made from metal such as aluminum and a release layer 81B made from fluorine contained resin and formed over an outer peripheral surface of the primary tubular member 81A. The heat roller 81 is rotatably supported to a frame (not illustrated) of the fixing device 8, and is adapted to rotate in a clockwise direction in FIG. 2A upon input of driving force from a motor (not illustrated) positioned in the housing 2.

The halogen lamp 82 functions as a heater to heat the heat roller 81. The halogen lamp 82 is positioned in an internal space of the heat roller 81 and extends along a rotation axis of the heat roller 81. The halogen lamp 82 emits light when powered to heat the heat roller 81 by radiation heat.

The endless belt 83 is a tubular-shaped member elongated in the axial direction, and has flexibility. The endless belt 83 includes a base layer made from metal such as stainless steel or resin such as polyimide resin, and a release layer formed over an outer peripheral surface of the base layer and made from fluorine resin. The endless belt 83 is driven to circularly move in the counterclockwise direction in FIG. 2A by the rotation of the heat roller 81.

Incidentally, lubricant such as grease is coated on an inner peripheral surface of the endless belt 83. Thus, enhanced slidability between the inner peripheral surface of the endless belt 83 and a first surface 84A (described later) of the elastic member 84 can be provided, to promote circular movement of the endless belt 83.

The elastic member 84 is a plate shaped elongated in the axial direction and has a generally rectangular cross-section. The elastic member 84 is made from elastic material such as rubber for performing elastic deformation. The elastic member 84 may be made from any kind of resin having elasticity. The elastic member 84 is positioned at an internal space of the endless belt 83. More specifically, the elastic member 84 has the first surface 84A facing and contacting the inner peripheral surface of the endless belt 83, and nips the endless belt 83 in cooperation with the heat roller 81 which is positioned at an outside of the endless belt 83. The elastic member 84 has a second surface 84B opposite to the first surface 84A.

The adhering plate 85 is a plate shaped elongated in the axial direction, and is made from metal such as stainless steel. Therefore, the adhering plate 85 has rigidity higher than that of the elastic member 84, and has coefficient of heat conductivity higher than that of the elastic member 84.

Figure 2B:
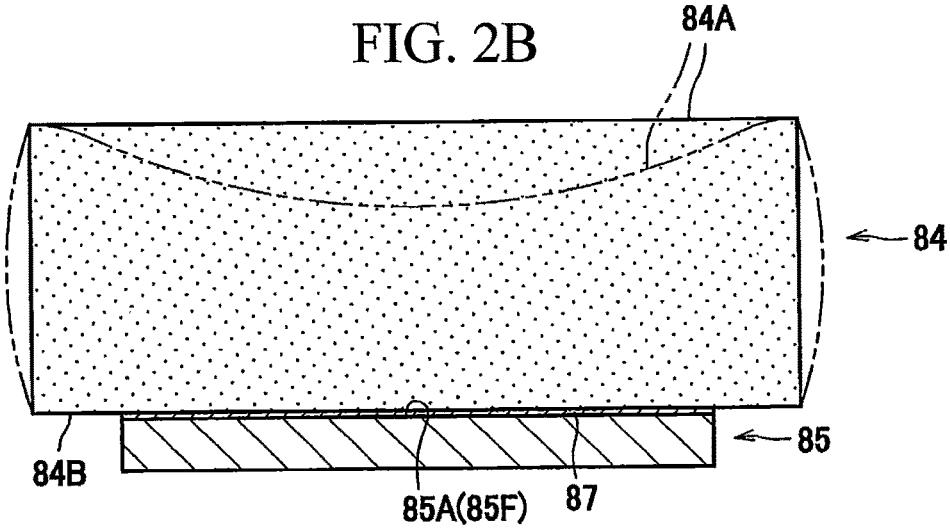
FIG. 2B is an enlarged cross-sectional view of an elastic member and an adhering plate in the fixing device according to the embodiment as viewed in an axial direction of the fixing device.

The adhering plate 85 is adhered to the second surface 84B of the elastic member 84. In this embodiment, the adhering plate 85 is adhered to the second surface 84B of the elastic member 84. Specifically, the adhering plate 85 has a third surface 85A facing the elastic member 84, and the third surface 85A has an adhering portion 85F. The adhering portion 85F is adhered to the second surface 84B of the elastic member 84 with an adhesive agent. In the depicted embodiment, approximately all of the third surface 85A functions as the adhering portion 85F. That is, as illustrated in FIG. 2B, the adhering plate 85 is adhered to the second surface 84B of the elastic member such that approximately all region of the third surface 85A is coated with the adhesive agent.

Figure 4:
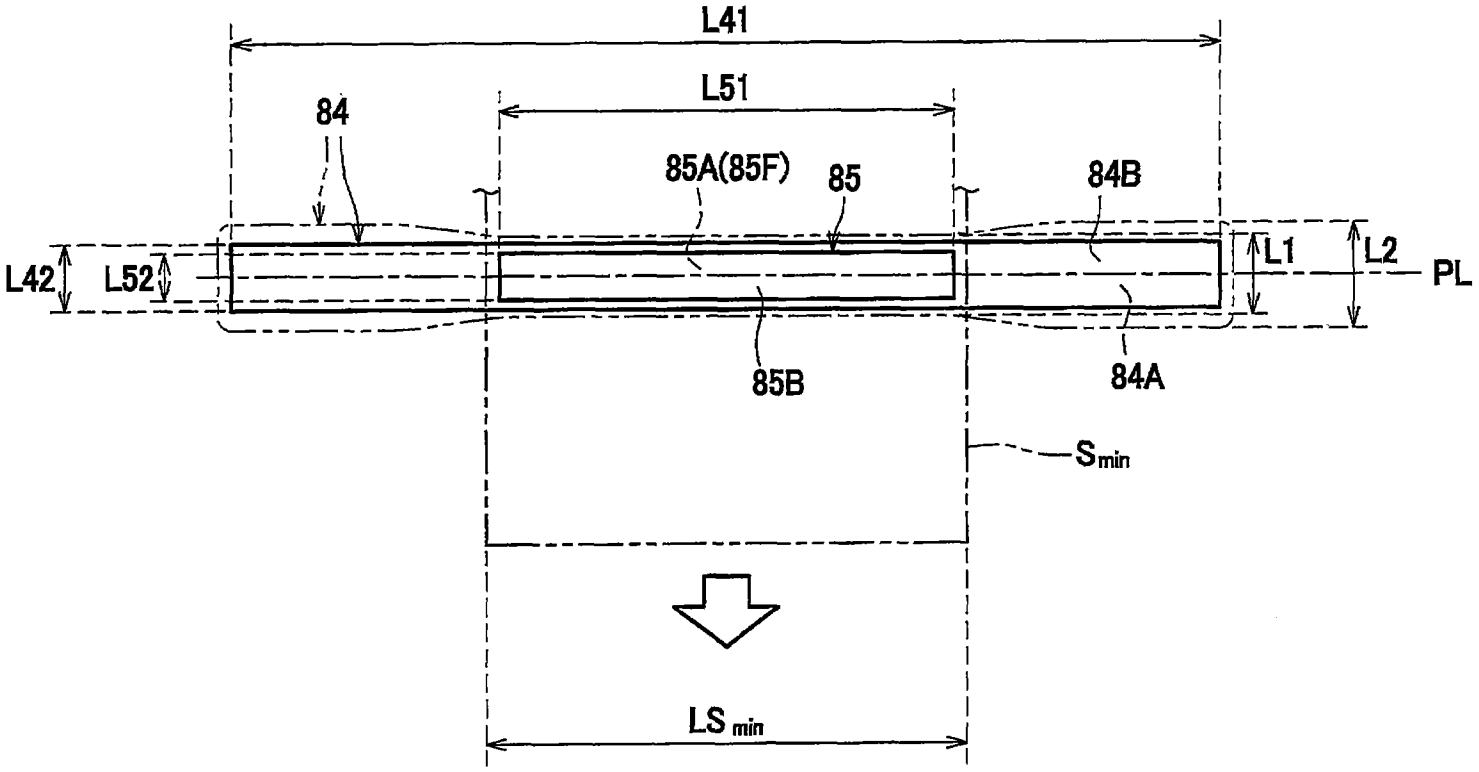
FIG. 4 is a view illustrating the adhering plate and the elastic member as viewed from the adhering plate in the fixing device according to the embodiment.

As illustrated in FIG. 4, the adhering plate 85 has a length L51 in the axial direction smaller than a length L41 of the elastic member 84 in a natural state in the axial direction. The natural state of the elastic member 84 means the state in which the elastic member 84 has an original shape without being elastically deformed. It is noted that the length L41 of the elastic member 84 in the natural state is indicated by a solid line in FIG. 4. In the depicted embodiment, since an entire area of the third surface 85A is the adhering portion 85F, the adhering portion 85F has the length L51 in the axial direction smaller than the length L41 of the elastic member 84 in the axial direction. The adhering plate 85 has a fourth surface 85B opposite to the third surface 85A.

Further, the adhering portion 85F has a cross-sectional shape taken along a plane PL indicated by a dotted chain line which is perpendicular to the conveying direction as illustrated in FIG. 4. In any portion of the cross-sectional shape, the length L51 is smaller than the length L41. Specifically, the adhering portion 85F has a plurality of cross-sectional shapes taken along a plurality of planes PL arrayed in the conveying direction, and the plurality of planes PL ranges from a plane PL on a front edge of the third surface 85A to a rear edge of the third surface 85A. In any of the plurality of cross-sectional shapes, the length L51 is smaller than the length L41.

Further, the length L51 of the adhering plate 85 (length L51 of the adhering portion 85F) in the axial direction is not more than a length $LS_{min}$ of a minimum size sheet $S_{min}$ in the axial direction that can undergo image fixing with the fixing device 8.

Further, the adhering plate 85 (adhering portion 85F) has a length L52 in the conveying direction slightly smaller than a length L42 of the elastic member 42 in the natural state in the conveying direction. It is noted that the length L42 of the elastic member in the natural state is indicated by a solid line in FIG. 4.

The adhering plate 85 (adhering portion 85F) is positioned at a center portion of the elastic member 84 in the axial direction. Further, the adhering plate 85 is positioned at a center portion of the elastic member 84 in the conveying direction. Therefore, the adhering plate 85 is positioned at generally center portion of the elastic member 84 as viewed in the upward/downward direction.

Figure 3:
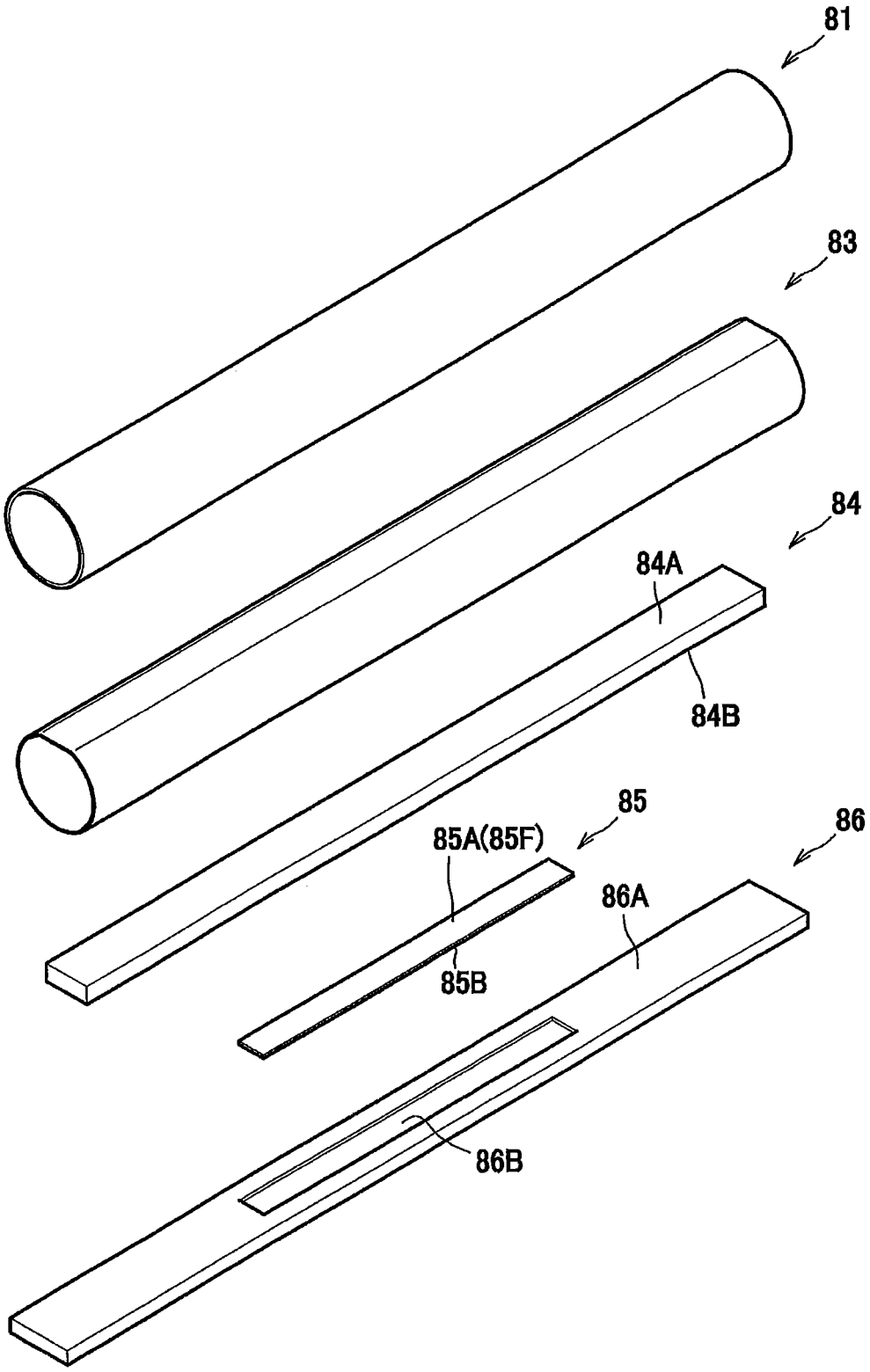
FIG. 3 is a perspective view of a heat roller, an endless belt, the elastic member, the adhering plate, and a holding portion in the fixing device according to the embodiment.

As illustrated in FIGS. 2A and 3, the holding member 86 is adapted to hold the elastic member 84 through the adhering plate 85. The holding member 86 is elongated in the axial direction and is made from resin having heat resistivity. The holding member 86 is positioned in the internal space of the endless belt 83, and has end portions in the axial direction supported to the frame (not illustrated) of the fixing device 8. The holding member 86 has a support surface 86A facing the elastic member 84 and a regulation portion 86B formed at a generally center portion of the support surface 86A.

The support surface 86A is adapted to support the second surface 84B of the elastic member 84, and has a rectangular shape elongated in the axial direction. The support surface 86A is generally flat surface.

The regulation portion 86B is a recessed portion having a rectangular shape into which the adhering plate 85 can be inserted, and is adapted to regulate movement of the adhering plate 85 in the axial direction and the conveying direction. Specifically, the regulation portion 86B has a length in the axial direction approximately equal to the length L51 of the adhering plate 85, and has a length in the conveying direction approximately equal to the length L52 of the adhering plate 85. Further, the regulation portion 86B has a depth approximately equal to a thickness of the adhering plate 85. Thus, the adhering plate 85 can be fitted with the regulation portion 86B.

The adhering plate 85 is held to the holding member 86 by fitting the adhering plate 85 with the regulation portion 86B with the fourth surface 85B of the adhering plate 85 being in confrontation with a bottom surface of the recessed regulation portion 86B. Because the adhering plate 85 is held by the holding member 86, the elastic member 84 to which the adhering plate 85 is adhered is held to the holding member 86 through the adhering plate 85. Incidentally, a part of the second surface 84B of the elastic member 84 is adhered to the adhering portion 85F of the adhering plate 85, and a remaining part of the second surface 84B is not adhered to a component such as the holding member 86.

Figure 5A:
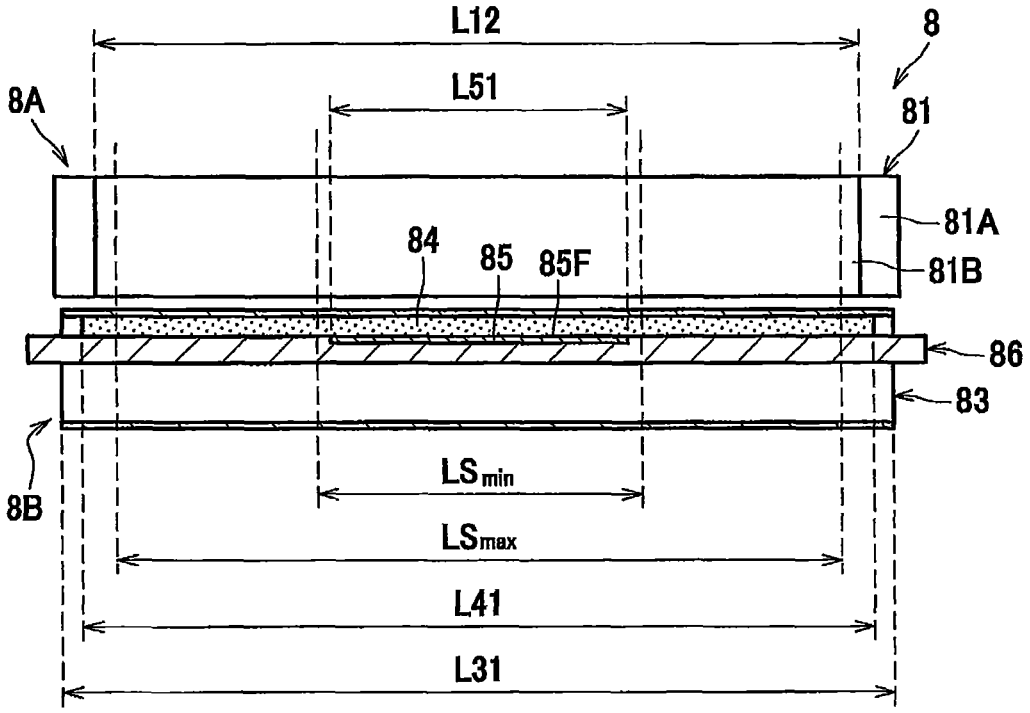
FIG. 5A is a cross-sectional view showing a nip release position of the fixing device according to the embodiment as viewed in a conveying direction of a sheet in the fixing device.
Figure 5B:
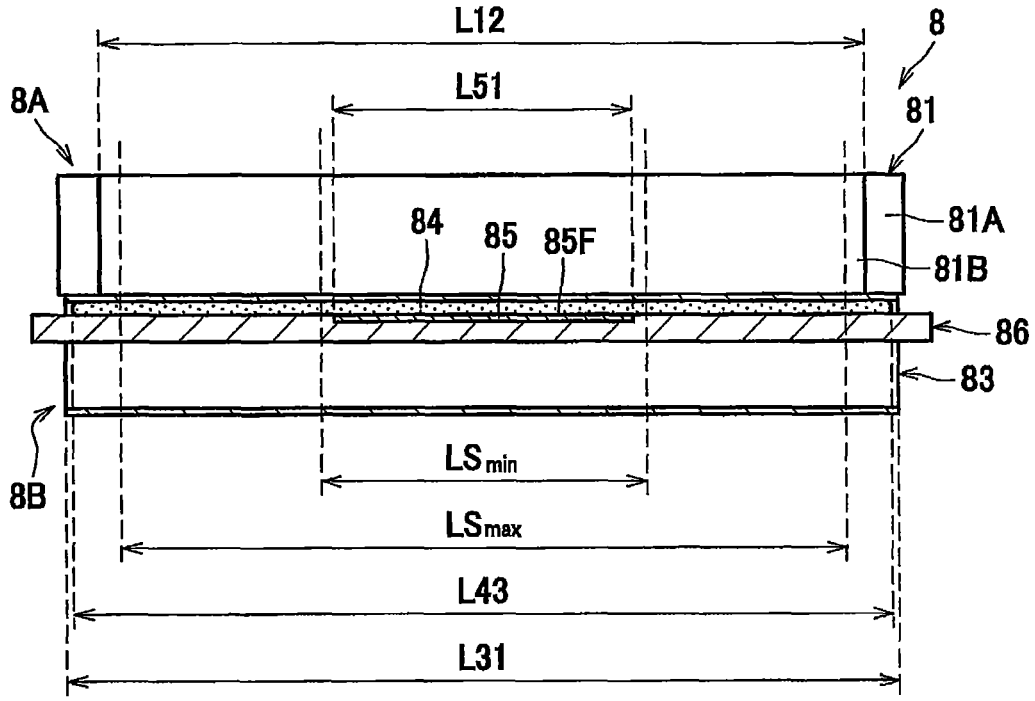
FIG. 5B is a cross-sectional view showing a nip position of the fixing device according to the embodiment as viewed in the conveying direction.

As shown in FIGS. 5A and 5B, one of the heat unit 8A and the pressure unit 8B is movably supported to the other of the heat unit 8A and the pressure unit 8B. With this structure, the one of the heat unit 8A and the pressure unit 8B is able to approach the other of the heat unit 8A and the pressure unit 8B in an approaching direction, and remove from the other of the heat unit 8A and the pressure unit 8B in a separating direction. Therefore, at least one of the heat unit 8A and the pressure unit 8B is movable between a nip-release position and a nip position. The nip-release position is a position where the heat roller 81 is separated from the endless belt 83, as shown in FIG. 5A. The nip position is a position where the heat roller 81 is in contact with the endless belt 83, as shown in FIG. 5B. When the heat unit 8A and the pressure unit 8B are separated from each other at the nip-release position, as shown in FIG. 5A, the elastic member 84 is in the natural state.

When the heat unit 8A and the pressure unit 8B are positioned at the nip position, one of the heat unit 8A and the pressure unit 8B is urged to the other of the heat unit 8A and the pressure unit 8B. In this embodiment, when the heat unit 8A and the pressure unit 8B are positioned at the nip position, one of the heat roller 81 and the holding member 86 is urged to the other of the heat roller 81 and the holding member 86. Thus, the elastic member 84 and the heat roller 81 are urged to each other interposing the endless belt 83 therebetween, so that the elastic member 84 is elastically deformed in conformance with the shape of the heat roller 81. Thus, the nip region N is formed between the heat roller 81 and the endless belt 83, as shown in FIG. 2.

Figure 6A:
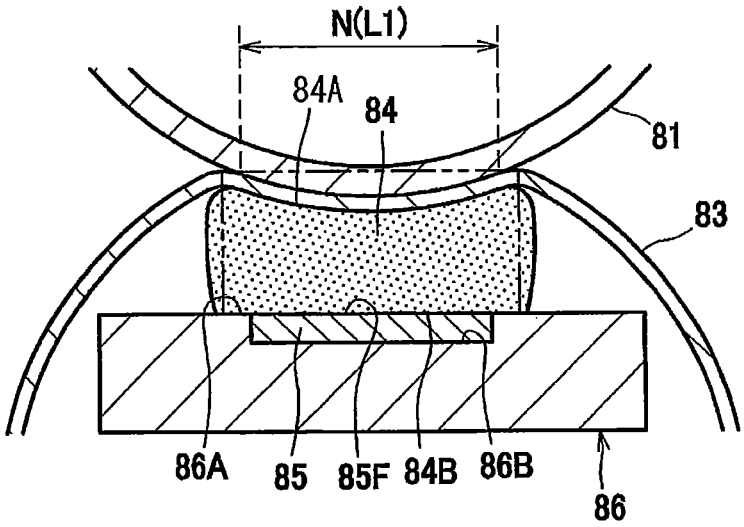
FIG. 6A is a view for description of deformation of the elastic member at an axially center portion of the elastic member in the fixing device according to the embodiment.
Figure 6B:
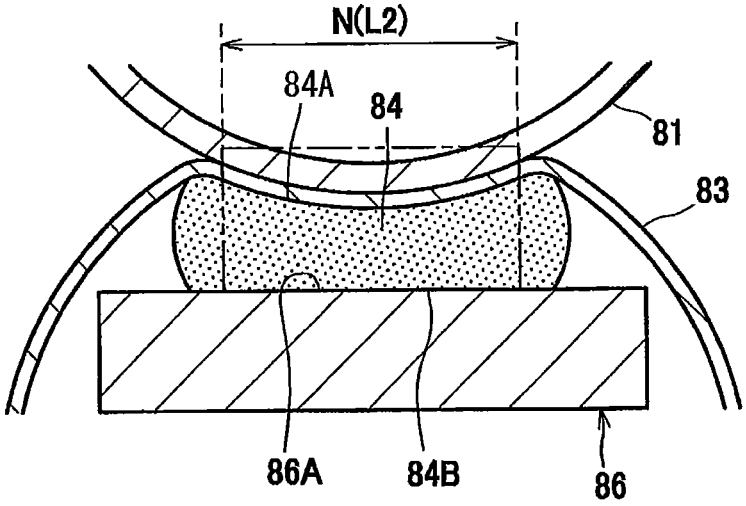
FIG. 6B is a view for description of deformation of the elastic member at an axially end portion of the elastic member in the fixing device according to the embodiment.

As illustrated in FIG. 6A, since the second surface 84B of the elastic member 84 is adhered to the adhering portion 85F of the adhering plate 85 at the center portion of the elastic member 84 in the axial direction, the adhering portion 85F constrains a position of a most part of the elastic member 84. On the other hand, as illustrated in FIG. 6B, since the second surface 84B of the elastic member 84 is not adhered to the adhering portion 85F of the adhering plate 85 at each end portion of the elastic member 84 in the axial direction, each end portion of the elastic member 84 is free from constraint from the adhering portion 85F. Therefore, an amount of deformation in the conveying direction at each end portion of the elastic member 84 in the axial direction as illustrated in FIG. 6B is greater than the mount of deformation in the conveying direction at the center portion of the elastic member 84 in the axial direction as illustrated in FIG. 6A.

As a result, the first surface 84A of the elastic member 84 is generally concaved in shape such that the nip width L2 at each end portion of the elastic member 84 in the axial direction is greater than the nip width L1 at the center portion of the elastic member 84 in the axial direction as illustrated in FIGS. 6A, 6B, and 4. Here, the nip width is a length in the conveying direction in the nip region N formed between the heat roller 81 and the endless belt 83.

As illustrated in FIG. 5A, the length L51 of the adhering plate 85 (the length L51 of the adhering portion 85F) in the axial direction is smaller than a length $LS_{max}$ of a maximum size sheet not shown in the axial direction that can undergo image fixing with the fixing device 8. Additionally, the release layer 81B of the heat roller 81 has a length L12 in the axial direction greater than the length $LS_{max}$ of the maximum size sheet in the axial direction. Further, the length L41 of the elastic member 84 in the natural state is greater than the length L12 of the release layer 81B in the axial direction, and smaller than a length L31 of the endless belt 83 in the axial direction.

As illustrated in FIG. 5B, when the heat unit 8A and the pressure unit 8B are at the nip position and the elastic member 84 is elastically deformed, a length L43 of the elastic member 84 in the axial direction is slightly larger than the length L41 of the elastic member 84 in the natural state. In this case, the length L43 of the elastic member 84 in the axial direction is also smaller than the length L31 of the endless belt 83 in the axial direction.

According to the above-described embodiment, the second surface 84B of the elastic member 84 has an adhered part adhered to the adhering plate 85 and a free part free from the adhering plate 85. Therefore, elastic deformation of the elastic member 84 at the adhered part is restrained by the adhering portion 85F, whereas the elastic member 84 at the free part can be largely elastically deformed. In this way, the nip width can be varied in the axial direction. According to the above-described embodiment, the nip width can be set by suitably setting dimension of the adhering portion 85F, i.e., dimension of the adhering plate 85. Therefore, the nip width setting achieved in the above described embodiment is easier than the conventional nip width setting by shaping the elastic member.

Further, since the length L51 of the adhering plate 85 (adhering portion 85F) in the axial direction is smaller than the length L41 of the elastic member 84 in the axial direction, difference in the nip width can be largely set between a portion existing the adhering plate 85 and a portion where the adhering plate 85 does not exist.

Further, since the holding member 86 includes a regulation portion 86B preventing the adhering plate 85 from moving in the axial direction, the adhering plate 85 and the elastic member 84 can be subjected to proper positioning in the axial direction. Accordingly, a nip width changing portion in the axial direction can be desirably set.

Further, since the regulation portion 86B is a recessed portion into which the adhering plate 85 can be inserted, the position of the adhering plate 85 and the elastic member 84 in the axial direction can be easily set by positioning the adhering plate 85 within the regulation portion 86B. Accordingly, the nip width changing portion in the axial direction can be easily set. Further, since the recessed regulation portion 86B in which the adhering plate 85 can be inserted is formed at the support surface 86A, a portion of the second surface 84B of the elastic member 84 which portion is not supported by the adhering plate 85 can be stably supported by support surface 86A. Accordingly, difference in nip pressure between the portion supported by the adhering plate 85 and a portion not supported by the adhering plate 85 can be made small.

Further, since each end portion of the elastic member 84 in the axial direction is easily deformed in the conveying direction because the adhering portion 85F is positioned at the center portion of the elastic member 84 in the axial direction, the nip width L2 at each end portion of the elastic member 84 can be greater than the nip width L1 at the center portion of the elastic member 84. Accordingly, in the nip region N, a sheet conveying speed at each end portion of the sheet in the axial direction can be higher than a sheet conveying speed at the center portion of the sheet in the axial direction. This speed difference generates tension directing outward in the axial direction and opposite directions, preventing the sheet S discharged from the portion between the heat roller 81 and the endless belt 83 from generation of wrinkles.

Further, since the adhering plate 85 having coefficient of heat conductivity higher than that of the elastic member 84 is positioned at the center portion in the axial direction, increase in temperature at each end region of the nip region N in the axial direction can be restrained. Specifically, in the case of fixing image on a small size sheet S, the nip region N includes a heat removed area at which heat is absorbed into the sheet S as a result of passing the sheet S, and heat non-removed areas which are each end portion in the axial direction at which heat is not removed due to non-passage of the sheet S. Therefore, temperature at each end portion in the axial direction of the elastic member 84 may be increased.

According to the above-described embodiment, since the adhering plate 85 having coefficient of heat conductivity higher than that of the elastic member 84 is positioned at the center portion in the axial direction, heat can be easily transmitted from each end portion of the elastic member 84 toward the center portion thereof. Accordingly, equalized temperature of the elastic member 84 in the axial direction can be provided, to restrain temperature increase at each end portion. Further, since heat is congregated at the center portion in the axial direction, temperature at the center portion can be stabilized without excessive temperature decrease. Thus, successful fixing operation can be obtained.

Further, since almost all region of the third surface 85A of the adhering plate 85 functions as the adhering portion 85F, the nip width can be set easily at high accuracy. Specifically, if the nip width is to be set by the concaved shaping of the elastic member, a large manufacturing error may occur since the elastic member is made from elastic material such as rubber. Therefore, accurate setting to the nip width may not be achievable. On the other hand, in accordance with the above-described embodiment in which the nip width is to be set by setting a size of the adhering portion 85F, i.e., by setting size of the adhering plate 85, a manufacturing error appearing in production of the adhering plate 85 made from metal whose rigidity is higher than the rigidity of the elastic member 84 is made small. Therefore, the nip width can be easily and accurately set in the above-described embodiment in comparison with a case where the nip width is set by controlling the shape of the elastic member.

Figure 7A:
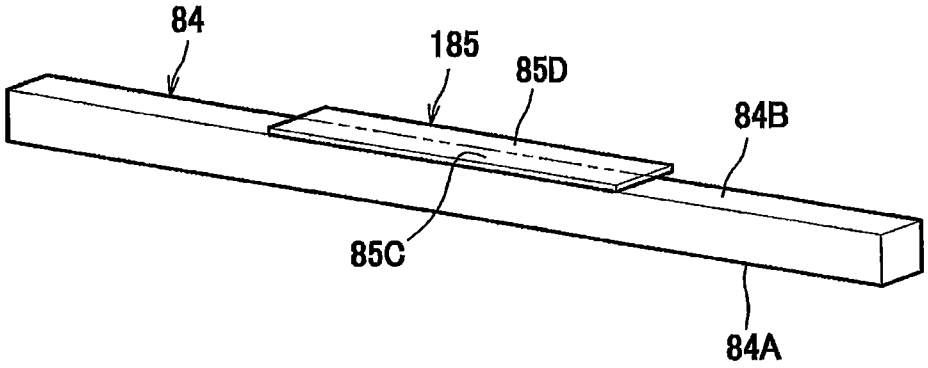
FIG. 7A is a perspective view of an adhering plate and an elastic member in a fixing device according to a first modification.
Figure 7B:
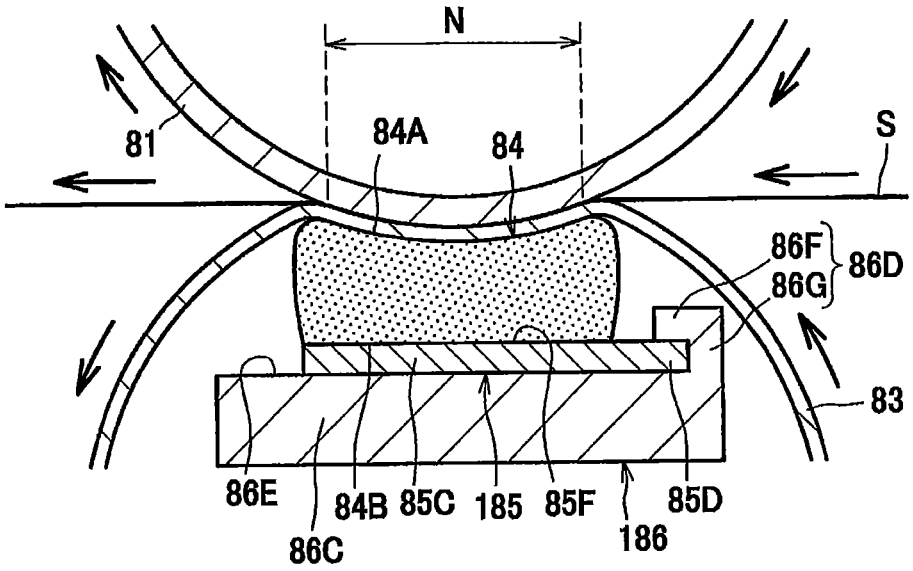
FIG. 7B is a view for description of deformation of the elastic member at an axially end portion of the elastic member in the fixing device according to the first modification.

Various modifications are conceivable. For example, according to a first modification illustrated in FIGS. 7A and 7B, an adhering plate 185 including a protruding portion 85D protruding outward of the elastic member 84 in the conveying direction, and a holding member 186 includes an engagement portion 86D engaged with the protruding portion 85D.

Specifically, the adhering plate 185 includes a main body portion 85C having the adhering portion 85F, and the protruding portion 85D protruding from the main body portion 85C toward an upstream side in the conveying direction. The adhering plate 185 is adhered to a holding surface 86E of the holding member 186 with an adhesive agent. The holding member 186 includes a main body portion 86C having the holding surface 86E, and the engagement portion 86D provided at an upstream end of the main body portion 86C in the conveying direction. The engagement portion 86D includes a stop wall 86F as an example of a wall and a connecting portion 86G. The stop wall 86F is positioned between the protruding portion 85D, which is engaged in the engagement portion 86D, and the endless belt 83 in the upward/downward direction perpendicular to the axial direction and the conveying direction. The connecting portion 86G connects an upstream end of the stop wall 86F to an upstream end of the main body portion 86C.

With this structure, the engagement of the protruding portion 85D with the stop wall 86F of the engagement portion 86D prevents the adhering plate 185 and the elastic member 84 adhered thereto from uplifting from the holding member 186. Incidentally, the protruding portion of the adhering plate and the engagement portion of the holding member may be provided at a downstream end in the conveying direction.

Figure 8:
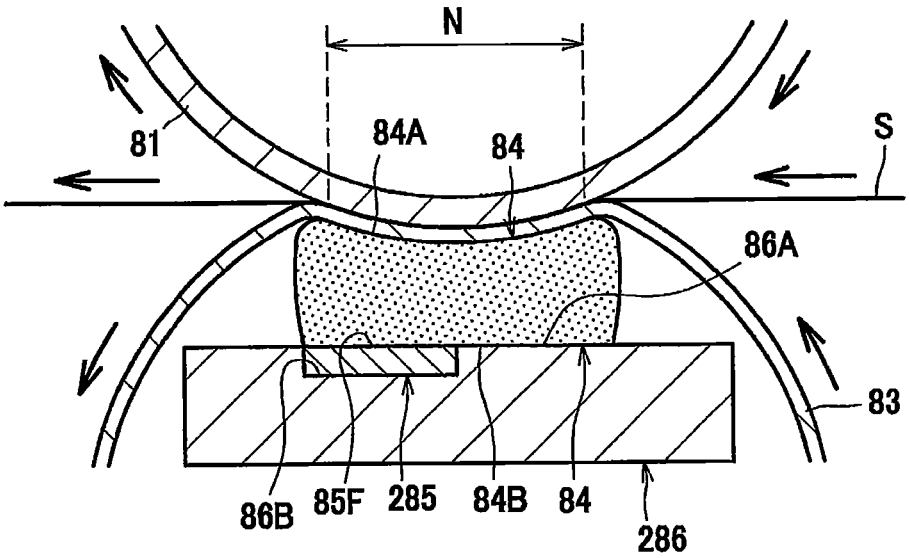
FIG. 8 is an enlarged cross-sectional view of a fixing device according to a second modification.

In the above-described embodiment, the adhering plate 85 is positioned at the center portion of the elastic member 84 in the conveying direction. However, the position of the adhering plate is not limited to this embodiment. According to a second modification illustrated in FIG. 8, an adhering plate 285 is positioned at a downstream end portion of the elastic member 84.

Specifically, the adhering plate 285 has a length in the axial direction smaller than the length L41 (FIG. 4) of the elastic member 84 in the axial direction, and has a length in the conveying direction smaller than the length L42 (FIG. 4) of the elastic member 84 in the conveying direction. The adhering plate 285 (adhering portion 85F) is positioned at a center portion of the second surface 84B in the axial direction, and is adhered to the second surface 84B at a region ranging from a downstream end of the second surface 84B to a center portion of the second surface 84B in the conveying direction. Further, a holding member 286 has a support surface 86A and a regulation portion 86B with which the adhering plate 285 is fitted. The regulation portion 86B is positioned in association with the position of the adhering plate 285. Specifically, the regulation portion 86B is formed at a center portion of support surface 86A in the axial direction and at a position deflecting to the downstream end of the holding member 286 in the conveying direction.

With this structure, the downstream end portion of the elastic member 84 in the conveying direction is constrained by the adhering portion 85F to restrain deformation. This structure is equivalent to a structure in which hardness of the downstream end portion of the elastic member is higher than hardness of an upstream end portion of the elastic member. Thus, an increased nip pressure can be provided at the downstream end portion of the nip region N, i.e., a sheet exit end portion of the nip region N defined by the downstream end portion of the elastic member 84 and the heat roller 81. With the high nip pressure at the exit end portion of the nip region N, a glossy image can be formed on the sheet S.

Although not illustrated, the adhering plate may be positioned at an upstream end portion of the elastic member. With this structure, since the downstream end portion of the elastic member is not constrained by the adhering plate, an amount of deformation at the downstream end portion can be increased, thereby increasing a nip width at the downstream end portion of the nip region in the conveying direction.

Further, in the above-described embodiment, the adhering plate 85 (adhering portion 85F) is positioned at the center portion of the elastic member 84 in the axial direction. However, the position of the adhering plate is not limited to the embodiment. According to a third modification illustrated in FIG. 9, each adhering plate 385 (adhering portion 85F) is positioned at each end portion of the elastic member 84 in the axial direction. With this structure, the center portion of the elastic member 84 in the axial direction can be easily deformed in the conveying direction, and therefore, the nip width at the center portion is greater than the nip width at each end portion as indicated by two dotted chain line. Accordingly, fix level of the toner image to the sheet S at the center portion can be increased.

Figure 9:
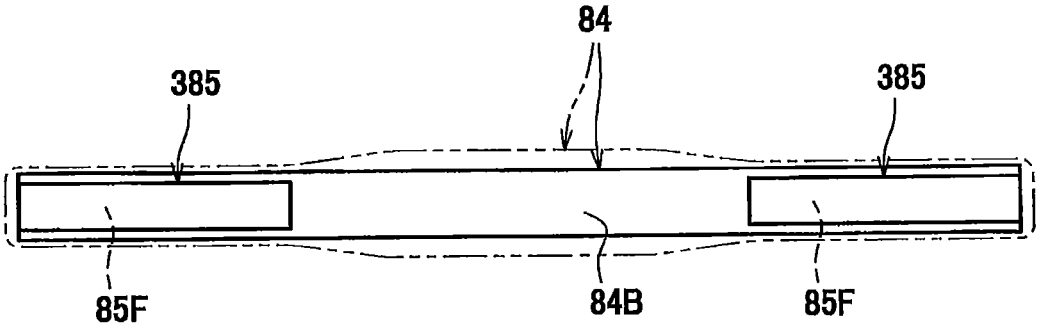
FIG. 9 is a view illustrating an adhering plate and an elastic member as viewed from the adhering plate in a fixing device according to a third modification.

Further, in a case where each end in the axial direction of one of the heat roller and the holding member is urged toward remaining one of the heat roller and the holding member by a spring, each end portion of the elastic member in the axial direction is largely deformed to increase the nip width at each end portion. Here, by incorporating the structure according to the third modification as shown in FIG. 9, the nip width at the center portion in the axial direction can be increased, so that nip width of the resultant nip region can be uniform in the axial direction.

Further, in the above-described embodiment, the length L51 in the axial direction of the adhering portion 85F is smaller than the length L41 in the axial direction of the elastic member 84 at any cross-sectional planes perpendicular to the conveying direction. However, the length difference is not limited to the embodiment, but the length difference is applicable to at least one of the cross-sectional planes. According to a fourth modification illustrated in FIG. 10, the length in the axial direction of the adhering portion 85F is smaller than the length L41 in the axial direction of the elastic member 84 at cross-sectional planes PL2 and PL3 perpendicular to the conveying direction, whereas the length in the axial direction of the adhering portion 85F is approximately equal to the length L41 in the axial direction of the elastic member 84 at cross-sectional plane PL1 perpendicular to the conveying direction.

Specifically, an adhering plate 485 includes a first part 485A, a second part 485B, and a third part 485C. The first part 485A is positioned at a center portion of the adhering plate 485 in the conveying direction. The second part 485B is positioned at a center portion of the adhering plate 485 in the axial direction, and at one side of the first part 485A in the conveying direction. The third part 485C is positioned at the center portion of the adhering plate 485 in the axial direction, and at a side opposite to the second part 385B with respect to the first part 485A in the conveying direction.

The second part 485B and the third part 485C have a length L53 in the axial direction smaller than the length L41 in the axial direction. The first part 485A has a length L54 in the axial direction greater than the length L41 in the axial direction. The third surface 85A of the adhering plate 485 includes the adhering surface 85F (F1, F2, F3) over an area of the first part 485A facing the second surface 84B of the elastic member 84. End areas A1, A2 of the adhering plate 485 in the axial direction protruding from ends of the elastic member 84 in the axial direction does not function as the adhering portion 85F.

Further, the adhering portion 85F is shaped such that a distance from one end E41 of the elastic member 84 in the conveying direction to one end E52 in the conveying direction of the second part 485B which is a central portion of the adhering portion 85F in the axial direction is smaller than a distance from the one end E41 to one end E511 in the conveying direction of the first part 485A, which is an end portion of the adhering portion 85F in the axial direction. Further, a distance from another end E42 of the elastic member 84 in the conveying direction to another end E53 in the conveying direction of the third part 485C which is the central portion of the adhering portion 85F in the axial direction is smaller than a distance from the other end E42 to another end E512 in the conveying direction of the first part 485A, which is the end portion of the adhering portion 85F in the axial direction.

With this structure, the adhering portions F2 and F3 of the second part 485B and the third part 486C have length in the axial direction smaller than the length L41 at any cross-sectional planes perpendicular to the conveying direction, and the adhering portion F1 of the first part 485A has a length in the axial direction equal to the length L41 at any cross-sectional planes perpendicular to the conveying direction.

More specifically, a ratio of a length of the adhering portion 85F in the conveying direction to a length of the elastic member 84 in the conveying direction at a predetermined position of the elastic member in the axial direction, hereinafter simply referred to "a ratio of the adhering portion 85F" is different from each other with respect to the axial direction. Specifically, according to the fourth modification illustrated in FIG. 10 and the embodiment illustrated in FIG. 4, the ratio of the adhering portion 85F at the center portion of the adhering portion 85F in the axial direction is larger than the ratio of the adhering portion 85F at the end portion of the elastic member in the axial direction. (In the embodiment illustrated in FIG. 4, the ratio of the adhering portion 85F at the end portion in the axial direction is zero since no adhering portion exists at the end portion).

With this structure, the end portions of the elastic member in the axial direction are not largely constrained by the adhering portion 85F because of low ratio of the adhering portion. Therefore, the end portions are easily deformable in the conveying direction. Further, according to the third modification illustrated in FIG. 9, the ratio of the adhering portion 85F at the end portions in the axial direction is larger than the ratio of the adhering portion 85F at the center portion in the axial direction (the ratio of the adhering portion at the center portion 85F is zero). Therefore, the center portion is easily deformable in the conveying direction, since the central portion of the elastic member 84 in the axial direction is not constrained by the adhering portion 85F because of zero ratio of the adhering portion 85F.

Figure 10:
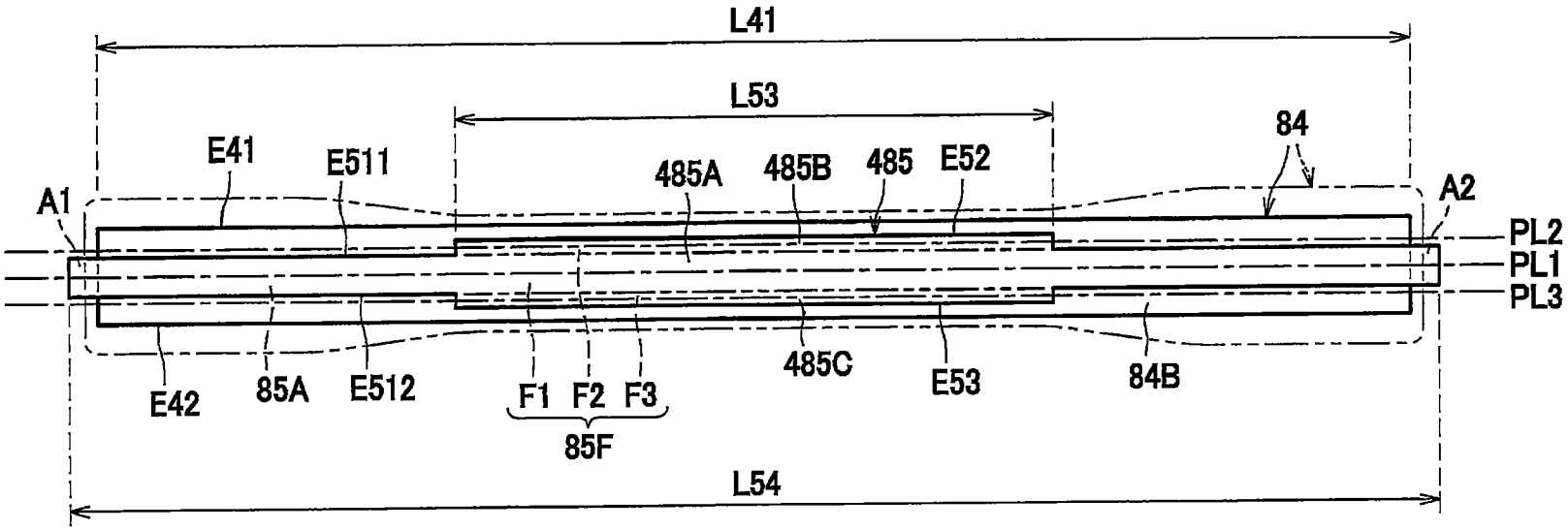
FIG. 10 is a view illustrating an adhering plate and an elastic member as viewed from the elastic member in a fixing device according to a fourth modification.

Incidentally, according to the fourth modification illustrated in FIG. 10, the distance from the ends E41, E42 of the elastic member 84 in the conveying direction to the ends in the conveying direction of the center portion of the adhering portion 85F in the axial direction is smaller than the distance from the ends E41, E42 of the elastic member 84 in the conveying direction to the ends in the conveying direction of the end portion of the adhering portion 85F in the axial direction. However, this difference in distance is not limited to the fourth modification. For example, the distance from the ends E41, E42 of the elastic member 84 in the conveying direction to the ends in the conveying direction of the end portion of the adhering portion 85F in the axial direction may be smaller than the distance from the ends of the elastic member in the conveying direction to the ends in the conveying direction of the center portion of the adhering portion 85F in the axial direction.

Further, in a case where not less than three adhering portions F1, F2, F3 whose lengths in the axial direction are different from each other are arrayed in the conveying direction as in the fourth modification illustrated in FIG. 10, high ratio of the adhering portion and a low ratio of the adhering portion can be provided in the axial direction by setting the length of the most upstream side and the most downstream side adhering portions F2 and F3 in the conveying direction smaller than the length of the elastic member in the axial direction. In the latter case, each adhering portions may be connected to each other in the conveying direction as illustrated in FIG. 10, or may be separated from each other in the conveying direction.

Figure 11A:
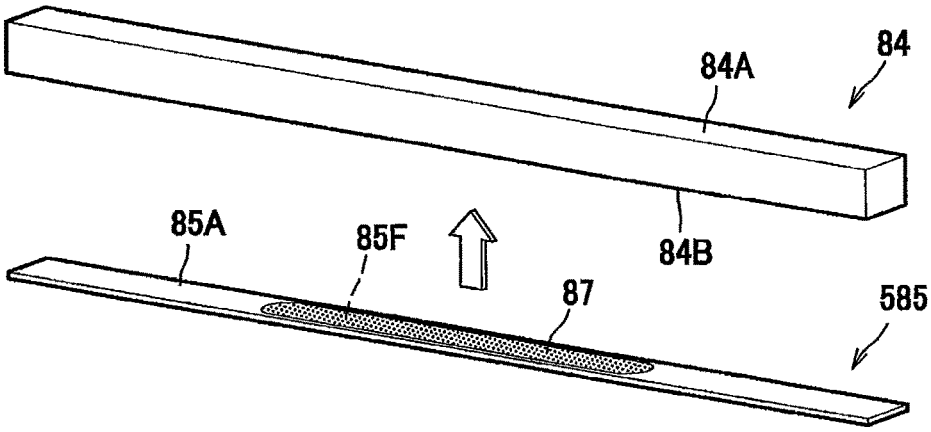
FIG. 11A is a perspective view of an adhering plate and an elastic member in a fixing device according to a fifth modification.
Figure 11B:
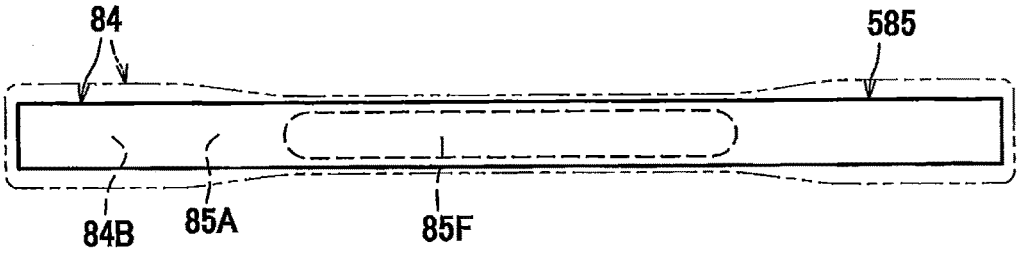
FIG. 11B is a view illustrating the adhering plate and the elastic member as viewed from the adhering plate in the fixing device according to the fifth modification.

Further, in the above-described embodiment, the entire region of the third surface 85A of the adhering plate 85 functions as the adhering portion 85F. However, the adhering portion 85F is not limited to the above-described embodiment. According to a fifth embodiment illustrated in FIGS. 11A and 11B, the adhering portion 85F is a part of the third surface 85A. That is, the part (adhering portion 85F) of the third surface 85A is coated with an adhesive agent 87, and an adhering plate 585 is adhered to the second surface 84A of the elastic member 84 through the adhesive agent 87. The adhering plate 585 may has a length in the axial direction equal to the length of the elastic member 84 in the axial direction. In other words, the adhering plate 585 may has a size equal to a size of the elastic member 84 as viewed in a direction perpendicular to the adhering plate 585.

Further, in the above-described embodiment, the regulation portion 86B formed at the holding member 86 has the length in the axial direction approximately equal to the length of the adhering plate 85 in the axial direction, and has the length in the conveying direction approximately equal to the length of the adhering plate 85 in the conveying direction. The regulation portion 86B is recessed to fittingly receive the adhering plate 85. However, the configuration of the regulation portion is not limited to the above-described embodiment. For example, the recessed regulation portion may have the length in the axial direction slightly greater than the length of the adhering plate 85 in the axial direction, and have the length in the conveying direction slightly greater than the length of the adhering plate 85 in the conveying direction. In the latter case, a surface of the adhering plate opposite to the adhering portion is adhered to a bottom surface of the regulation portion through an adhesive agent, so that the adhering plate can be held to the holding member.

Further, the above-described heat roller 81 and the endless belt 83 have structures as one of the examples, and structures other than the depicted structures are conceivable. For example, the described heat roller 81 and the endless belt 83 according to the above-described embodiment have bilayer structures including the primary tubular member and the release layer formed over the outer peripheral surface of the primary tubular member, or including the base layer and the release layer formed over the outer peripheral surface of the base layer. However, these may have not less than three layers.

Further, in the above-described embodiment, the heat unit 8A includes the heat roller 81 as the rotary body, and the pressure unit 8B includes the endless belt 83, the elastic member 84, and the adhering plate 85. However, the heat unit and the pressure unit are not limited to the above. For example, a fixing device may include a heat unit including an endless belt, an elastic member, and an adhering plate, and a pressure unit including a rotary body such as a pressure roller.

Further, in the above-described embodiment, a roller configuration such as the heat roller 81 is used as the rotary body. However, other configuration may be conceivable. For example, the rotary body may be an endless belt having flexibility such as the endless belt 83.

Further, in the above-described embodiment, the elastic member 84 is adhered to the adhering plate 85 as the adhering member with an adhesive agent. However, the adhering way of the elastic member 84 to the adhering plate 85 is not limited to the above. For example, the elastic member and the adhering member can be integrated into one member by insert molding Specifically, after the adhering member is put into a molding die, melting material for the elastic member is poured into the molding die and then solidified. In this way, the elastic member and the adhering member can be molded into one piece and adhered to each other.

Further, in the above-described embodiment, the adhering plate 85 is made from metal. However, the material of the adhering plate is not limited to the above. For example, the adhering plate 85 can be made from resin having stiffness higher than that of the elastic member 84 and a linear expansion coefficient less than or equal to that of the holding member 86. Preferably, the adhering plate 85 is made from the same resin as the material for the holding member 86 which is made from resin.

Further, in the above-described embodiment, the plate like adhering plate 85 is used as the adhering member. However, a block like member other than the plate like member is also available as the adhering member.

Further, in the above-described embodiment, the laser printer 1 adapted to form a monochromatic image on the sheet S is exemplified as the image forming apparatus provided with the fixing device. However, a printer adapted to form a color image on the sheet is also available. Further, in addition to the printer, a copying machine and a multi-function device provided with an image reader such as a flat-bed type scanner are also available as the image forming apparatus. Further, the image recording medium other than the sheet S is also available as long as the medium can provide image fixing function.

Further, each of the elements or parts which have been described in the above embodiment and the modifications can be arbitrarily combined for implementing the invention.

While the invention has been described in detail with reference to specific embodiment and modifications thereof, it would be apparent to those skilled in the art that various changes and modifications may be made therein without departing from the spirit and scope of the invention.

What is claimed is:

1. A fixing device comprising:

an endless belt defining an inner space;

a rotary body positioned outside of the endless belt, the rotary body having an axis extending in an axial direction;

an elastic member positioned at the inner space and configured to nip the endless belt in cooperation with the rotary body, the elastic member having a contact surface in contact with the endless belt, and an opposite surface opposite to the contact surface, the elastic member having a length in the axial direction; and an adhering member having rigidity higher than rigidity of the elastic member, and having an adhering portion adhered to the opposite surface of the elastic member, the adhering portion having a length in the axial direction smaller than the length of the elastic member with respect to at least one cross-sectional plane of the adhering member perpendicular to a conveying direction of an image recording medium.

2. The fixing device according to claim 1, wherein the length of the adhering member in the axial direction is smaller than the length of the elastic member in the axial direction with respect to any of cross-sectional planes of the adhering member perpendicular to the conveying direction of the sheet.

3. The fixing device according to claim 1 further comprising a holding member holding the adhering member, the holding member having a regulation portion regulating movement of the adhering member in the axial direction.

4. The fixing device according to claim 3, wherein the adhering member has a length in the axial direction smaller than the length of the elastic member in the axial direction; wherein the holding member has a support surface supporting the opposite surface of the elastic member, the regulation portion being a recessed portion forming in the support surface to receive the adhering member.

5. The fixing device according to claim 3, wherein the adhering member has a linear expansion coefficient less than or equal to a linear expansion coefficient of the holding member.

6. The fixing device according to claim 5, wherein the adhering member is made from same resin as resin of the holding member.

7. The fixing device according to claim 3, wherein the regulation portion is a recessed portion having a depth equal to a thickness of the adhering member.

8. The fixing device according to claim 1, wherein the adhering portion is positioned at a position corresponding to a center portion of the elastic member in the axial direction.

9. The fixing device according to claim 8, wherein the adhering member has a length in the axial direction not more than a length in the axial direction of the image recording medium having a minimum size and to which fixing operation is applicable.

10. The fixing device according to claim 1, wherein the adhering portion is positioned at a position corresponding to each end portion in the axial direction of the elastic member.

11. The fixing device according to claim 1, wherein the adhering member has a protruding portion protruding outward from the elastic member in the conveying direction;

the fixing device further comprising a holding member holding the adhering member, the holding member including an engagement portion having a wall engaged with the protruding portion and positioned between the protruding portion and the endless belt.

12. The fixing device according to claim 1, wherein the adhering member is positioned deflecting to a downstream end portion of the elastic member in the conveying direction.

13. The fixing device according to claim 1, wherein the adhering portion is an entire surface of the adhering member facing the elastic member.

14. The fixing device according to claim 1, wherein the elastic member is adhered to the adhering member with an adhesive agent.

15. The fixing device according to claim 1, wherein the elastic member comprises a plate shaped elongated in the axial direction.

16. The fixing device according to claim 1, wherein the adhering member is made from metal.

* * * * *